United States Patent [19]

Coakley et al.

[11] Patent Number: 4,470,469

[45] Date of Patent: Sep. 11, 1984

[54] SWIVEL HEAD FOR DRILLING AND MINING TOOL

[75] Inventors: John E. Coakley, Westfield; James J. Nolan, Brielle, both of N.J.

[73] Assignee: Slurry Mining Engrg. Inc., Westfield, N.J.

[21] Appl. No.: 282,912

[22] Filed: Mar. 23, 1982

Related U.S. Application Data

[63] Continuation-in-part of Ser. No. 136,283, Apr. 1, 1980, Pat. No. 4,348,058.

[51] Int. Cl.[3] ..... E21B 3/02; E21B 21/12

[52] U.S. Cl. ..... 175/170; 173/57; 175/215; 285/61

[58] Field of Search ..... 175/170, 213, 215; 173/57; 285/122, 123, 133 A, 168, 272, 274, 61; 308/196

[56] References Cited

U.S. PATENT DOCUMENTS

| | | | |
|---|---|---|---|
| 658,495 | 9/1900 | Williams | 173/57 |
| 1,761,826 | 6/1930 | Greve | 285/61 X |
| 2,614,898 | 10/1952 | Adams | 308/196 |
| 2,849,213 | 8/1958 | Failing | 175/215 X |
| 4,019,784 | 4/1977 | Ladin et al. | 308/196 X |
| 4,077,671 | 3/1978 | Bunnelle | 299/17 |

*Primary Examiner*—Ernest R. Purser

*Attorney, Agent, or Firm*—John E. Coakley

[57] ABSTRACT

A combination drilling and mining head is provided which engages in screwed connection to the uppermost and outermost section of the drill string and allows the tool string to be rotated by the power swivel during both the drilling and mining operations. A lateral connection on the stationary manifold of the swivel head connects to the annular space between the dual conduits for supplying drilling and mining fluid to the tool string, the center or discharge conduit is connected through a swivel for discharging drill cuttings during the drilling cycle and ore slurry during the mining mode. The center or discharge conduit can also be used to supply drilling or mining fluid through the center conduit to the tool string while the lateral connection on the stationary manifold is used to discharge the drill cuttings or slurry pumped through the annular space between the conduits.

5 Claims, 3 Drawing Figures

SWIVEL HEAD FOR DRILLING AND MINING TOOL

This is a continuation-in-part of application Ser. No. 136,283 filed Apr. 1, 1980, now U.S. Pat. No. 4,348,058 issued Sept. 7, 1982, and is assigned to the assignee of that invention.

BACKGROUND OF THE INVENTION

1. Field of the Invention

This invention pertains to improvements in swivel heads for borehole mining tools and particularly to a swivel head for a dual conduit tool string wherein the outer conduit is driven by the power swivel during drilling and mining while drilling or mining fluid is supplied to the annulus between the conduits or through the center conduit.

2. Description of the Prior Art

U.S. Pat. No. 4,077,671 issued to P. R. Bunnelle on Mar. 7, 1978 discloses a separate drilling (FIG. 2) and a mining head (FIG. 6) wherein the heads are alternated each time the function of the tool is changed. The swivel joint is axial with respect to the drill string in each head. The second below the axial swivel joint is driven by the torque wrench during mining.

SUMMARY OF THE INVENTION

The present invention provides a combination drilling and mining head which permits the outer conduit of the drill string to be driven by the power swivel during both the drilling and mining operations while supplying drilling and or mining fluid to the annulus between the conduits. The drilling and mining head is supported from a vertically movable hoist on a drilling derrick or mast capable of raising or lowering the drill string to contact the ore matrix at any desired level; a lateral connection on the stationary element of this head connects to the annular space between the conduits for supplying drilling and mining fluid to the tool string, the center conduit is connected through a swivel for discharging drill cuttings during the drilling cycle and ore slurry during the mining mode.

Operation of this novel drilling and mining head is made possible by the novel arrangement of the seals. Close dimensional tolerances are extremely important in high pressure seals. Seals surrounding and in contact with the circumference of the drill collar are subject to the variations due to out-of-roundness of the mating surfaces and the run-out and play incorporated in the bearings with no means of compensating for these dimensional clearances or provision to compensate for wear. Our method mounts the seals in the recesses of a flat flange surface extending radially from the axis of the drill string to have the lip seals rub on the stationary flat surface of the mating fluid supply manifold; the seals could also be installed in the stationary manifold as well.

The stationary element or manifold of the drilling and mining head surrounds the drill string and is mounted on four-point contact bearings in the recesses of the stationary and the rotating flanges of the swivel connection. A yoke secured to the cross-head is used to prevent the fluid supply manifold from turning. While the preferred bearings are type KG of the Kaydon Bearing Division of the Keene Corp., it will be realized that bearings capable of handling thrust, radial and moment loads, such as a skew-ring bearing, could be used. Prelubricated bearings can be used or the bearings can be lubricated from the stationary manifold of the swivel. Openings in the outermost section collar permit the drilling and mining fluid to pass from the stationary manifold of the swivel head to the annulus within the tool string.

The seal housing on the lower radial flange below the fluid supply manifold is provided with a take-up to preload the bearings sufficiently to remove the bearing play. While a keyed lock washer and nut are used to retain the position of the lower radial flange, it will be appreciated that lock nuts, two nuts or another form of locking device can also be utilized. Out-of-roundness and bearing run-out are minimized by the seals rubbing on the flat radial surface. A single seal or multiple seals can be employed. When more than one seal is used, reduced manifold pressure from a regulator can be directed between the seals to minimize the pressure drop across each seal; a small bleed orifice in the line after the regulator is employed to releave this pressure when the pressure in the manifold decreases. The capacity of the regulator being adequate to hold the pressure between the seals while a small volume is discharged through the bleed orifice. It will be appreciated that multiple seals could also be employed with or without the apparatus to control the reduced pressure between the seals. While lip seals are shown on the drawings it will be realized that other types of seals could also be employed.

It will also be appreciated that the drilling and mining fluid can be directed through the swivel of the center conduit and down the center conduit to the mining head while the annular space between the conduits is employed to convey the drill cuttings or slurry to discharge through the lateral connection on the stationary manifold of the drilling and mining head.

DESCRIPTION OF THE PREFERRED EMBODIMENT

Figures 1, 2, 3:
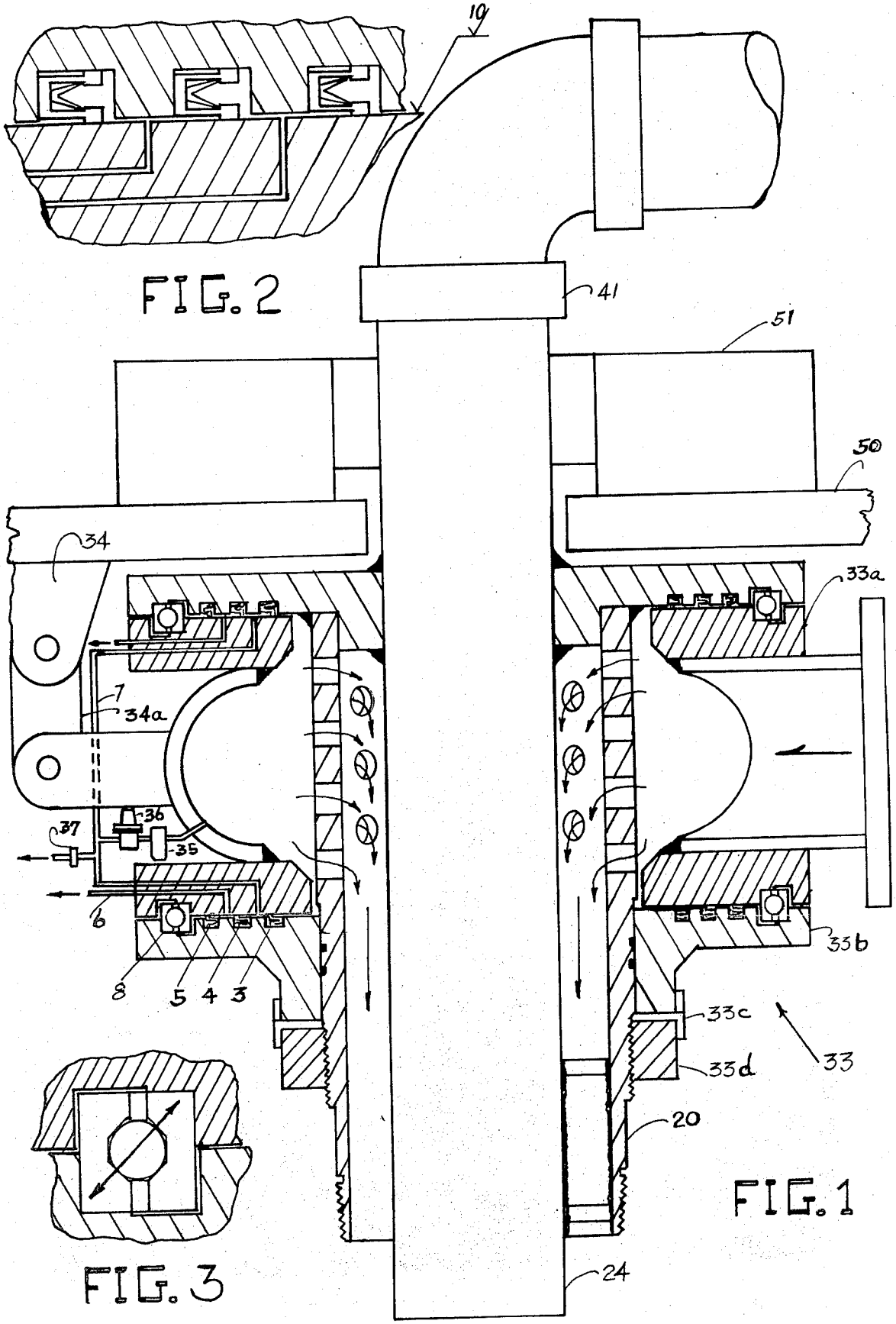
FIG. 1 is a vertical section of my combination drilling and mining head illustrating the radial orientation of the seals and the bearings together with the fluid flow pattern within the tool head. The illustration shows the method of imposing reduced manifold pressure between the seals and the pressure relief line prior to the seal adjacent to the bearing.
FIG. 2 is an enlarged view of the seal structure. The surface finish used by these seals is indicated.
FIG. 3 is an enlarged view of a section through the point-contact bearings indicating the method of handling bearing loads.

The borehole drilling and mining head is illustrated in section in FIG. 1; it can be used for direct or reverse circulation. The component numbers are the same as were used in application Ser. No. 136,283.

The power swivel 51 drives the outermost casing of the tool string 20 through a drilling and mining head 33 having a stationary fluid supply manifold 33*a* retained from rotating by the restraining yoke 34 and arms 34*a*. Thrust bearings 8 position the stationary manifold 33*a* with respect to the rotating flange attached to the drill string and to flange 33*b*. Close dimensional tolerances are extremely important in high pressure seals. Seals to withstand 1000 p.s.i.g. pressure must have the housings and mating surfaces machined to a maximum clearance of approx. 0.006". If the mating surfaces were about the axis of the drill string the bearing run-out and out-of-roundness would have to be held within this tolerance. In addition, any wear would require that the surfaces be built-up to be within the dimensional allowance. Mounting the mating surfaces radially with respect to the axis of the drill string permits the bearings 8 to be fitted snugly together removing bearing play, with shimming if necessary, and adjusted and secured by the take-up nut 33*d* and the keyed lock washer 33*c*. Although fluro-carbon lip seals are preferred for this service, it will be recognized that other seals can also be used. During mining when high pressures are used the rotation of the tool string is usually below one-half revolution per minute; intermittent rotation of the drill string is also possible to extend seal life. Although a single seal could be used, two seals 3, 4 are preferred with the water pressure from the stationary manifold 33*a* at 600 psig or above directed through the filter 35 and a pressure regulator 36 to reduce the pressure to about half the system pressure and piped 7 into the annulus between the seals to reduce the pressure drop across the first seal 3. In the conduit 7 connecting the reduced pressure seal water with annulus between the seals a bleed orifice 37 is inserted to reduce the pressure between the seals when the manifold pressure drops. An additional seal 5 is installed to prevent water entering the bearing 8. A bleed line 6 is installed before the seal 5 to draw-off any water that might pass through the seals. The lower flange 33*b* is keyed below the journal seals to the drill string 20 and rotates with it being retained with a screwed lock nut 33*d* to maintain rolling contact in the bearings and secured with a keyed lock washer 33*c* to prevent rotation of the lock nut 33*d*.

FIG. 2 is an enlarged view of the seal construction. The surface finish used by these seals is also indicated.

FIG. 3 is an enlarged view of a section through the point-contact bearings. The method of handling the bearing loads is illustrated.

I claim:

1. A combination drilling and mining swivel head for rotating a tool string by a power swivel during both the drilling and mining cycles while supplying fluid to the annulus between the conduits of a dual conduit tool string and discharging the slurry from the inner conduit through a swivel which comprises:

(a) an inner conduit of a tool string supported and driven by a power swivel on a drilling hoist with a portion thereof extending through the swivel and with a pipe swivel at the upper end to discharge the effluent from the inner conduit through a stationary discharge pipe;

(b) an upper radial flange welded to the inner conduit and the outer conduit of the drill string with recesses for housing the seals used to contain the fluid pumped into the tool and with a recess for a bearing to provide relative rotation and to maintain the relative position of this flange with respect to the flange on the stationary inlet manifold;

(c) a stationary inlet manifold surrounding the outer casing of the drill string with mounting flanges extending radially from the axis of the drill string and with matching recesses to receive the bearings that maintain the relative position of the manifold with respect to the mating flanges of the tool string and to provide a rubbing surface for the seals, the manifold having brackets or arms secured to the hoist to prevent rotation of the manifold and the stationary manifold having an inlet nozzle for receiving fluid into the manifold;

(d) an outer drill string casing welded to the upper radial flange and perforated between the flanges of the stationary manifold to receive the full flow of fluid entering the manifold and directed down the annulus between the conduits, screwed pipe threads at the base of the pipe section to receive the female or box threads of a mating lower tool section and with a threaded section for receiving and securing the lower radial flange and lock nut and having a keyway for the lower flange section and for the lockwasher used to prevent the locknut from turning;

(e) a lower radial flange dimensionally mated and mounted on the outer drill string casing and extending radially from the axis of the drill string and having recesses to house the radial seals used to contain the fluid of the manifold and a recess to retain the bearing used to permit rotation of the mating flanges while maintaining a close dimensional tolerance for the seals, the lower radial flange being secured to the outer drill string casing by a nut and lock washer which is keyed to the casing;

(f) means for pumping the supply fluid into the manifold of the drilling and mining head and directing the fluid down the annulus between the conduits, returning the drill cuttings and or slurry through the inner conduit to the discharge swivel and through the discharge conduit.

2. An apparatus according to claim 1 wherein multiple seals are used.

3. An apparatus according to claim 1 wherein three concentric seals are used and two vent lines are drilled into the upper and lower flanges of the stationary inlet manifold and communicating with the annulus between the seals, the vent lines between the first and the second seals from the axis of the drill string receiving reduced water pressure from a water pressure regulator connected to the high pressure manifold, the second vent line communicating with the annulus between the second and third seals from the axis of the drill string being vented to a drain.

4. An apparatus according to claim 1 wherein the center conduit supplies drilling and mining fluid to the drill string through a swivel and the slurry or drill cuttings is discharged through the annulus between the conduits and through the lateral connection on the stationary manifold of the drilling and mining head.

5. An apparatus according to claim 1 wherein point-contact bearings are mounted radially from the axis of the tool string to support the stationary manifold on the drill string.

* * * * *